United States Patent [19]

Buescher

[11] 4,151,440

[45] Apr. 24, 1979

[54] CATHODE HEATER ASSEMBLY FOR ELECTRON DISCHARGE DEVICE

[75] Inventor: William E. Buescher, Senèca Falls, N.Y.

[73] Assignee: GTE Sylvania Incorporated, Stamford, Conn.

[21] Appl. No.: 896,644

[22] Filed: Apr. 17, 1978

[51] Int. Cl.[2] ..... H01J 1/24

[52] U.S. Cl. ..... 313/340; 313/346 R

[58] Field of Search ..... 313/340, 337, 346 R

[56] References Cited

U.S. PATENT DOCUMENTS

| | | | |
|---|---|---|---|
| 3,881,124 | 4/1975 | Buescher et al. | 313/37 |
| 3,947,715 | 3/1976 | Puhak | 313/337 X |
| 3,958,146 | 5/1976 | Buescher et al. | 313/337 X |
| 4,009,409 | 2/1977 | Buescher et al. | 313/337 |

*Primary Examiner*—Alfred E. Smith
*Assistant Examiner*—Charles F. Roberts
*Attorney, Agent, or Firm*—William H. McNeill

[57] ABSTRACT

The titled assembly comprises a ceramic substrate having opposed surfaces bearing thereon discrete metallized patterns. One of the patterns serves as a base for an electron emissive material and the other serves as a heater.

6 Claims, 2 Drawing Figures

CATHODE HEATER ASSEMBLY FOR ELECTRON DISCHARGE DEVICE

BACKGROUND OF THE INVENTION

This invention relates to cathode-heater assemblies for electron discharge devices and more particularly to such assemblies exhibiting fast warm-up capabilities for use with cathode ray tubes of the type employed in black and white and color television receivers.

The cathodes conventionally employed in such tubes normally have a warm-up time of 12 to 15 seconds; that is, it requires that long a time for sufficient electrons to be present from the cathode to be drawn to the anode and establish a viewable raster on the screen of the tube.

Previously used fast warm-up cathodes (with warm-up times from 3.5 to six seconds) have employed various modifications of conventional cathodes such as are shown in U.S. Pat. Nos. 3,881,124; 3,947,715; 3,958,146; and 4,009,409, or they have employed complicated and expensive structures.

However, it is believed it would be an advance in the art to provide a simple and economical cathode with warm-up times faster than those achieved heretofore.

OBJECTS AND SUMMARY OF THE INVENTION

It is, therefore, an object of the invention to obviate the disadvantages of the prior art.

It is another object of the invention to enhance fast warm-up cathodes.

Yet another object of the invention is the provision of a fast warm-up cathode that is simple and economical to build.

These objects are accomplished in one aspect of the invention by the provision of a cathode-heater assembly which comprises a ceramic substrate having opposed surfaces bearing thereon discrete, metallized patterns. One of the patterns serves as a base for an electron emissive material and the other serves as a heater. This construction is simple and economical to fabricate and will provide a warm-up time of 2.5 seconds.

DESCRIPTION OF THE PREFERRED EMBODIMENTS

Figure 1:
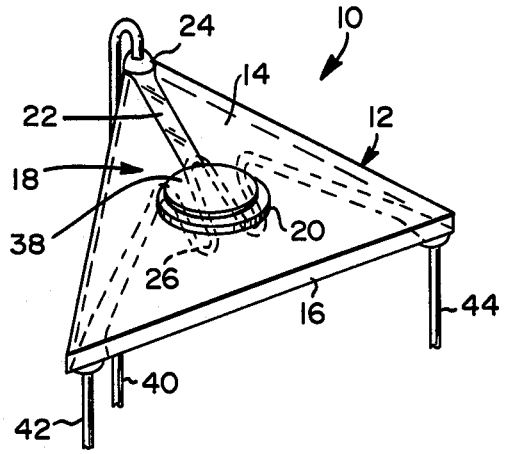
FIG. 1 is a perspective view of an embodiment of the invention.

For a better understanding of the present invention, together with other and further objects, advantages and capabilities thereof, reference is made to the following disclosure and appended claims taken in conjunction with the above-described drawings.

Referring now to the drawings with greater particularity there is shown a fast warm-up cathode-heater assembly 10 having a ceramic substrate 12 with opposed surfaces 14 and 16. The substrate material is preferably synthetic sapphire; that is, substantially pure, hexagonal crystal, $\alpha$ alumina ($Al_2O_3$) although other aluminas of at least 97% purity may be employed. The material should be as thin as possible to still maintain the necessary mechanical strength, and ranges of between 0.006" to 0.007" are preferred.

Surface 14 has thereon a first metallized layer or pattern 18 comprised of a substantially centrally located disc 20 which has emanating therefrom a single connector 22 which extends to a first edge 24 of substrate 12.

Figure 2:
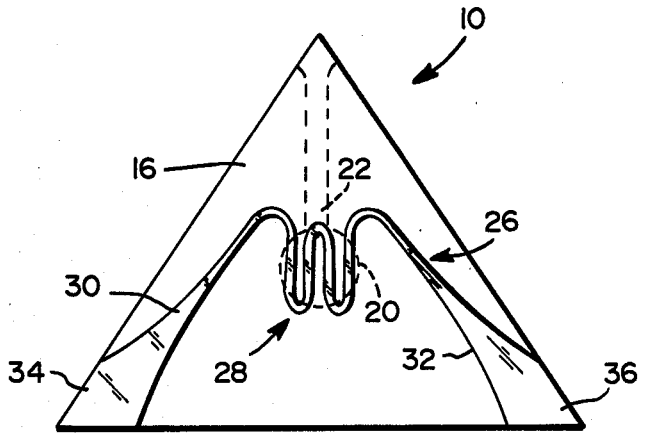
FIG. 2 is a plan view of the underside thereof.

A second metallized layer or pattern 26 (see FIG. 2) is provided on surface 16 and comprises a central portion 28 of serpentine configuration which underlies disc 20. A pair of metallized connectors 30, 32 emanate from opposite sides of the serpentine configuration and extend to opposed edges 34, 36 of substrate 12.

Edges 34, 36 are remote from first edge 24 to provide lead isolation.

To provide adequate area for connection of appropriate lead in wires, the terminal ends of connector 22 and connectors 30, 32 are preferably widened or broadened, as shown in the drawings.

Numerous techniques are available for depositing the metallized layers 18 and 26. The preferred method is to vapor deposit a suitable material such as molybdenum, nickel, cobalt or tungsten on substrate 12 and then, using conventional photo-resist techniques, etching out the desired pattern.

As noted above, widened areas are preferably provided at the terminal ends 24, 34 and 36 of connectors 22, 30 and 32 and suitable electric leads, such as cathode lead 40 and heater leads 42, 44 are brazed or welded thereto.

As shown in the instant embodiment, substrate 12 takes the form of an equilateral triangle with ¼" sides; however, other configurations can be used. With a layer of emissive material 38 on disc 20 approximately 0.060" in diameter, the cathode area can be brought to raster temperature (450° C.) within 2.5 seconds. To achieve these conditions power is applied to achieve a terminal temperature of 800° C. The power input for achieving the 800° C is below ½ watt with, heater power being 250 ma at approximately 2 volts.

It will be seen from the above that there is herein provided an unique and novel cathode-heater assembly ideally suited for use in cathode ray tubes by its fast warm-up properties. Further, it is simple and economical to construct.

While there have been shown and described what are at present considered to be the preferred embodiments of the invention, it will be apparent to those skilled in the art that various changes and modifications can be made therein without departing from the scope of the invention as defined by the appended claims.

What is claimed is:

1. A fast warm-up heater-cathode assembly for an electron discharge device comprising: a substrate of substantially pure, hexagonal crystal $\alpha$ alumina having opposed surfaces; a first metallized layer substantially centrally located on one of said surfaces; and a second metallized layer on an opposite surface, said second layer being at least partially serpentine configuration with said serpentine configuration being aligned with said first layer.

2. The assembly of claim 1 wherein a single metallized connector emanates from said first metallized layer and extends to a first edge of said substrate.

3. The assembly of claim 2 wherein metallized connectors emanate from opposite ends of said serpentine configuration and extend to opposed edges of said substrate, said opposed edges being remote from said first edge.

4. The assembly of claim 3 wherein said substrate is triangular in configuration.

5. The assembly of claim 3 wherein said metallized layers are selected from the group consisting of molybdenum, nickel, cobalt and tungsten.

6. The assembly of claims 2, 3, 4 or 5 wherein said first metallized layer has thereon a coating of an electron emissive material.

* * * * *